US006955156B2

(12) United States Patent
Noda et al.

(10) Patent No.: US 6,955,156 B2
(45) Date of Patent: Oct. 18, 2005

(54) INJECTION PUMP AND FUEL DME FEED DEVICE OF DIESEL ENGINE WITH THE INJECTION PUMP

(75) Inventors: Toshifumi Noda, Saitama (JP); Shinya Nozaki, Saitama (JP); Daijo Ushiyama, Saitama (JP); Yukihiro Hayasaka, Saitama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 0 days.

(21) Appl. No.: 10/495,057

(22) PCT Filed: Nov. 8, 2002

(86) PCT No.: PCT/JP02/11657

§ 371 (c)(1),
(2), (4) Date: May 5, 2004

(87) PCT Pub. No.: WO03/040549

PCT Pub. Date: May 15, 2003

(65) Prior Publication Data

US 2005/0016499 A1 Jan. 27, 2005

(30) Foreign Application Priority Data

Nov. 9, 2001 (JP) ..... 2001-344198
Oct. 1, 2002 (JP) ..... 2002-288653

(51) Int. Cl.[7] ..... F02M 37/00; F02M 59/44

(52) U.S. Cl. ..... 123/364; 123/467; 123/503; 123/514; 123/516; 123/525

(58) Field of Search ..... 123/1 A, 364, 123/446, 467, 503, 514, 516, 525–527, 529, 541; 417/289

(56) References Cited

U.S. PATENT DOCUMENTS 4,222,717 A * 9/1980 Clouse et al. ..... 417/499
5,485,818 A * 1/1996 McCandless ..... 123/294
5,690,077 A * 11/1997 Ofner et al. ..... 123/525
5,690,078 A * 11/1997 Ofner ..... 123/529
6,119,664 A * 9/2000 McCandless ..... 123/527
6,176,225 B1 * 1/2001 Sams et al. ..... 123/549
6,209,525 B1 * 4/2001 Konishi et al. ..... 123/467
6,805,105 B2 * 10/2004 Kato et al. ..... 123/514

* cited by examiner

*Primary Examiner*—Weilun Lo
(74) *Attorney, Agent, or Firm*—Priest & Goldstein

(57) ABSTRACT

In an injection pump element 2, a communication route for communicating an injection pipe 3 connected to a fuel liquid outlet 212 and an inner peripheral surface of a plunger barrel 25 is formed by a purge passage 242 formed in a delivery valve seat 24, a purge passage 252 formed in the plunger barrel 25, and a purge port 253. When the injection pump element 2 is in a non-injection state, the plunger 26 is rotated circumferentially to such a rotational position that a purge groove 265 formed in an outer peripheral surface of the plunger 26 and a purge port 253 formed in an inner peripheral surface of the plunger barrel 25 are communicated to each other. The purge groove 265 is communicated to a fuel gallery 11 via a hole 263 and a notch 262. When the injection pump element 2 is in the non-injection state, the injection pipe 3 is communicated to the fuel gallery 11 even if the delivery valve 23 is closed.

9 Claims, 10 Drawing Sheets

(a)

(b)

INJECTION PUMP AND FUEL DME FEED DEVICE OF DIESEL ENGINE WITH THE INJECTION PUMP

TECHNICAL FIELD

This invention relates to an injection pump of a DME fuel supply device for a diesel engine and a DME fuel supply device for a diesel engine provided with the injection pump.

BACKGROUND ART

A diesel engine which uses clean-burning DME (dimethyl ether), instead of light oil, as fuel is now attracting attention as means for reducing air pollution by diesel engines. DME fuel is a liquefied gas fuel unlike light oil as a conventional fuel. That is, DME fuel has a boiling point lower than that of light oil and evaporates at room temperature whereas light oil exist as a liquid at atmospheric pressure and temperature. Thus, when DME fuel is used in a conventional diesel engine, the DME fuel evaporates when the supply pressure to an injection pump is low. Thus, to supply liquid DME fuel to an injection pump, the supply pressure to the injection pump must be higher than that required to deliver light oil to the injection pump.

Thus, when DME fuel is used in a conventional diesel engine, the amount of fuel leaking through a gap between a plunger barrel and a plunger of an injection pump for delivering the DME fuel to a fuel injection nozzle of the engine into a cam chamber of the injection pump is greater than the amount of fuel leaking when light oil fuel is used due to the high supply pressure to the injection pump. In addition, DME has a lower viscosity than that of light oil and thus easily leaks through the gap, which increases the amount of fuel leaking through the gap. There is a possibility that the DME fuel leaked through the gap between the plunger barrel and the plunger flows into the cam chamber of the injection pump and is evaporated therein and then the evaporated fuel enters the crank chamber of the engine and is ignited therein.

Also, there is a possibility that when DME fuel remaining in the injection system after stopping the engine leaks from a nozzle seat of the fuel injection nozzle into a cylinder of the engine and is evaporated therein and then the evaporated DME fuel fills the cylinder, abnormal combustion such as knocking occurs at the start of the engine and the engine cannot be normally started, resulting in significant vibration and noise.

As a prior art to solve the problems, JP-A-Hei 10-281030 discloses a DME fuel supply device in which the gap between the plunger barrel and the plunger is reduced to decrease the amount of DME fuel leaking into the cam chamber of the injection pump. The prior art, however, only decreases the amount of leaked DME fuel and does not solve the problem caused by the leaking DME fuel.

A DME fuel supply device is known in order to prevent leaked DME fuel from entering the lubricating oil in the crank chamber in which the cam chamber of the injection pump and the crank chamber of the engine are separated from each other and DME fuel leaked through the gap between the plunger barrel and the plunger into the cam chamber of the injection pump and DME fuel remaining in the injection system after stopping the engine are retrieved to a tank by an electric compressor or the like.

Since the cam chamber of the injection pump of the DME fuel supply device and the crank chamber of the engine are separated from each other and since DME fuel leaked through the gap between the plunger barrel and the plunger into the cam chamber of the injection pump is retrieved to the fuel tank by an electric compressor or the like, it is possible to prevent evaporated DME fuel from entering the crank chamber of the engine. Also, since the DME fuel remaining in the injection system after stopping the engine is retrieved to the tank by an electric compressor, it is possible to prevent abnormal combustion such as knocking at the start of the engine caused by the DME fuel remaining in the injection system after stopping the engine.

However, even when the DME fuel remaining in the injection system after stopping the engine is retrieved to the tank by an electric compressor, it is impossible to completely retrieve DEM fuel remaining in a fuel passage between the outlet of an injection pump element and the inlet of a fuel injection nozzle since a valve of the injection pump element is closed when the injection pump element is in a non-injection state. Thus, the DME fuel in the injection system cannot be retrieved completely and there still remains the possibility of abnormal combustion such as knocking at the start of the engine.

This invention has been made in view of the above circumstances and it is, therefore, an object of this invention to provide a DME fuel supply device for a diesel engine which can retrieve DME fuel remaining between the injection pump element and the fuel injection nozzle after stopping the engine.

DISCLOSURE OF THE INVENTION

In accomplishing the above object, the first aspect of this invention is an injection pump of a DME fuel supply device for a diesel engine having a feed pump for pressurizing DME fuel in a fuel tank to a specified pressure and delivering it into a feed pipe, an injection pump having an injection pump element with a delivery valve which can be opened and closed by up and down movement of a plunger in engagement with a camshaft rotated by rotation transmitted from a driving shaft of the diesel engine and which can deliver DME fuel in an fuel gallery delivered via the feed pipe in a specified amount to an injection pipe communicated to a fuel injection nozzle of the diesel engine at specified timing, an overflow fuel pipe for returning DME fuel overflowed from the fuel injection nozzle and DME fuel overflowed from the injection pump to the fuel tank, and residual fuel retrieving means for retrieving DME fuel remaining in the fuel gallery and the overflow fuel pipe after stopping the diesel engine to the fuel tank, the injection pump provided with injection state switching means for switching the injection pump element between an injection state in which the delivery valve is opened and closed by a cam of the camshaft and a non-injection state in which the delivery valve is not opened and closed even when the plunger is moved up and down by the cam, wherein the injection pump element allows communication between the injection pipe and the fuel gallery even if the delivery valve is closed only in the non-injection state.

Since the injection pipe and the fuel gallery are communicated to each other even if the delivery valve is closed after the injection pump element has been brought into the non-injection state by the injection state switching means and the diesel engine has been stopped, DME fuel remaining in the injection pipe can be retrieved when the residual fuel retrieving means retrieves the DME fuel remaining in the fuel gallery.

According to the injection pump of the first aspect of this invention, DME fuel remaining between the injection pump element and the fuel injection nozzle after the stopping of the engine can be retrieved since the DME fuel remaining in the injection pipe can be retrieved when the residual fuel retrieving means retrieves the DME fuel remaining in the fuel gallery after the stopping of the engine. It is, therefore, possible to obtain an effect of avoiding abnormal combustion such as knocking which prevents the engine from starting normally and causes significant vibration and noise.

The second aspect of this invention is the injection pump of the first aspect, wherein the plunger of the injection pump element has a generally cylindrical shape and is rotated circumferentially in a plunger barrel by the injection state switching means and the injection amount of the DME fuel is changed according to the rotational position of the plunger, and wherein the injection pump element is brought into the non-injection state and a purge passageway for communicating the injection pipe and the fuel gallery is formed when the plunger is rotated to such a rotational position that the injection amount is zero.

In the injection pump of the second aspect of this invention, the plunger is rotated circumferentially by the injection state switching means and the injection amount of the DME fuel is changed according to the rotational position of the plunger, and the injection pump element is brought into the non-injection state and a purge passageway for communicating the injection pipe and the fuel gallery is formed when the plunger is rotated to such a rotational position that the injection amount is zero, whereby the effect of the first aspect of this invention can be achieved.

The third aspect of this invention is the injection pump of the second aspect, wherein the injection pump element has a delivery valve holder having a delivery valve insertion hole communicated to the injection pipe, the delivery valve received in the delivery valve insertion hole for reciprocating movement, a delivery valve seat disposed integrally with the delivery valve holder and having a valve seat part for shutting off the communication between the injection pipe and the fuel gallery to establish a valve-closed state when a valve part of the delivery valve comes into contact with it, a delivery spring for urging the delivery valve toward the delivery valve seat, a plunger barrel disposed integrally with the delivery valve seat and having a compression chamber communicated to the delivery valve seat, the plunger received in the compression chamber for reciprocating movement and having an end opposed to the delivery valve, and a plunger spring for urging the plunger toward the cam, wherein, when the injection pump element is in the injection state, the plunger is pushed up from the valve-closed state by the cam to shut off the communication between the compression chamber and the fuel gallery, DME fuel in the compression chamber pushes up to open the delivery valve and brings the delivery valve into an open state, the DME fuel in the compression chamber is delivered under pressure to the injection pipe through the delivery valve in the open state, the compression chamber and the fuel gallery are communicated to each other again via a notch formed in an outer peripheral surface of the plunger, and the liquid pressure in the compression chamber is decreased and the delivery valve is closed by the urging force of the delivery spring, and wherein, when the injection pump element is in the non-injection state, the plunger is rotated circumferentially to such a rotational position that a purge groove formed in an outer peripheral surface of the plunger and a purge port formed in an inner peripheral surface of the plunger barrel are communicated to each other by the injection state switching means, and the injection pipe and the fuel gallery are communicated to each other via the purge port, the purge groove, and a purge passage formed in the delivery valve seat for communicating the injection pipe and the purge port.

Since the injection pump element is brought into the non-injection state from the injection state when the plunger is rotated circumferentially by the injection state switching means to such a rotational position that the purge groove formed in an outer peripheral surface of the plunger and the purge port formed in an inner peripheral surface of the plunger barrel are communicated to each other, a purge passageway for communicating the injection pipe and the fuel gallery is formed via a purge passage formed in the delivery valve seat for communicating the injection pipe and the purge port and the DME fuel remaining in the injection pipe can be retrieved when the residual fuel retrieving means retrieves the DME fuel remaining in the fuel gallery after the stopping of the engine.

Thus, in the injection pump of the third aspect of this invention, the injection pump element is brought into the non-injection state from the injection state when the plunger is rotated circumferentially by the injection state switching means to such a rotational position that the purge groove formed in an outer peripheral surface of the plunger and the purge port formed in an inner peripheral surface of the plunger barrel are communicated to each other, whereby the effect of the second aspect of this invention can be achieved.

The fourth aspect of this invention is the injection pump of any one of the first to third aspects, wherein the injection pump has a cam chamber in which the camshaft is placed and lubricating oil is contained and which has an exclusive lubricating system separated from a lubricating system of the diesel engine, and wherein an oil separator for separating DME fuel from lubricating oil containing DME fuel and a compressor driven by a cam of the camshaft for pressurizing the separated DME fuel and delivering it to the fuel tank are disposed in the cam chamber.

Since the cam chamber has an exclusive lubricating system which is separated from the lubricating system of the diesel engine, there is no possibility that DME fuel leaked through a gap between the plunger and the plunger barrel of the injection pump element enters the lubricating system of the diesel engine. Also, DME fuel is separated from lubricating oil containing DME fuel and the separated DME fuel is delivered to the fuel tank by the compressor, it is possible to prevent degradation of the lubrication performance of the lubricating oil caused by DME fuel mixed in the lubricating oil. Further, the compressor is driven by a cam in the cam chamber, there is no need for a driving source, such as an electric motor, for driving the compressor.

According to the injection pump of the fourth aspect of this invention, it is possible to obtain an effect, in addition to the effect of any one of the first to third aspects, of eliminating the possibility that the DME fuel having entered the lubricating system of the diesel engine is evaporated and the evaporated DME fuel enters the crank chamber of the engine and is ignited therein since there is no possibility that DME fuel leaked though the gap between the plunger and the plunger barrel of the injection pump element enters the lubricating system of the diesel engine.

Also, since it is possible to prevent degradation of the lubricating performance of the lubricating oil caused by DME fuel mixed in the lubricating oil, it is possible to prevent degradation of the performance of the injection pump caused by degradation of the lubrication performance of the lubricating oil or the like. Further, since there is no need for a driving source for driving the compressor, it is possible to achieve a low power consumption injection pump.

The fifth aspect of this invention is the injection pump of any one of the second to fourth aspects, wherein the injection state switching means has a control rack engaged with the plunger and disposed to make a reciprocating movement rotating the plunger circumferentially, and a governor having high-speed control means for drawing the control rack in a direction to decrease the fuel injection amount so that the rotational speed of the diesel engine cannot exceed a permissible maximum limit, wherein the control rack has a purge rack position outside its moving range between a full rack position determined by the high-speed control means and a non-injection rack position at which the injection pump element is switched from the injection state to the non-injection state, wherein the governor moves the control rack to the purge rack position when the residual fuel retrieving means retrieves the DME fuel remaining in the fuel gallery and the overflow fuel pipe to the fuel tank after the stopping of the diesel engine, and wherein the injection pump element is in the non-injection state with the purge passageway formed only when the control rack is in the purge rack position.

The purge rack position is provided within the range of the moving range of the control rack in which the injection pump element is in the non-injection state and the purge passageway is formed in the injection pump element only when the control rack controlled by the governor is in the purge rack position. When the residual fuel retrieving means retrieves DME fuel remaining in the fuel gallery and the like after stopping the diesel engine, the governor moves the control rack to the purge rack position. Thus, the purge passageway in the injection pump element can be formed only when the DME fuel remaining in the fuel gallery and the like after the stopping of the diesel engine is retrieved. When the DME fuel remaining in fuel gallery and the like is to be left unretrieved in the non-injection state after the stopping of the engine when, for example, the engine is stopped by an idle stop function, the purge passageway is not formed even if the injection pump element is in the non-injection state.

According to the injection pump of the fifth aspect of this invention, it is possible to obtain an effect, in addition to the effect of any one of the first to fourth aspects, that the purge passageway is not formed even if the injection pump element is in the non-injection state when the DME fuel remaining in fuel gallery and the like is to be left unretrieved in the non-injection state after the stopping of the engine.

Also, since the purge rack position is provided, the adjustment of the rotational position of the plunger at which the purge passageway is formed and the rack position of the control rack can be adjusted easily and reliably in the work of adjusting the injection pump element and the governor.

The sixth aspect of this invention is the injection pump of the fifth aspect, wherein the purge rack position is provided on the non-injection state side from the non-injection rack position within the moving range of the control rack.

According to the injection pump of the sixth aspect of this invention, it is possible to obtain an effect, in addition to the effect of the fifth aspect, of eliminating the possibility that the purge passageway is formed when the injection pump element is in the injection state since the purge rack position is provided on the non-injection state side from the non-injection rack position within the moving range of the control rack.

The seventh aspect of this invention is a DME fuel supply device for a diesel engine provided with an injection pump according to any one of the first to sixth aspects.

According to the DME fuel supply device for a diesel engine of the seventh aspect of this invention, it is possible to obtain the effect of any one of the first to sixth aspects of this invention in a DME fuel supply device for a diesel engine.

The eighth aspect of this invention is the DME fuel supply device for a diesel engine of the seventh aspect, wherein the residual fuel retrieving means has an aspirator which is interposed between the feed pipe and the overflow fuel pipe and which circulates DME fuel delivered from the feed pump to the fuel tank so that the DME fuel remaining in the fuel gallery and the overflow fuel pipe can be sucked by the circulating DME fuel and retrieved to the fuel tank.

According to the DME fuel supply device for a diesel engine of the eighth aspect of this invention, it is possible to obtain an effect, in addition to the effect of the seventh aspect, that the DME fuel remaining in the fuel gallery and the overflow pipe can be retrieved to the fuel tank using the feed pump as a driving source without providing a pump or the like for retrieving the remaining DME fuel.

The ninth aspect of this invention is the DME fuel supply device for a diesel engine of the seventh or eighth aspect, wherein the feed pump is disposed in the vicinity of a DME fuel delivery port of the fuel tank which is located below the liquid level of DME fuel in the fuel tank.

In a conventional fuel supply device for a diesel engine using light oil as fuel, the fuel in the fuel tank is sucked by a feed pump provided in an injection pump. However, as described before, DME fuel evaporates at atmospheric pressure and temperature. Thus, when DME fuel in the fuel tank is sucked using a feed pump on the side of the injection pump, there is a possibility that the pressure in the fuel tank is decreased and the DME fuel is evaporated.

When the DME fuel delivery port of the fuel tank is located below the liquid level of DME fuel in the fuel tank and the feed pump is disposed in the vicinity of the DME fuel delivery port of the fuel tank and delivers the DME fuel to the injection pump, it is possible to prevent a significant pressure decrease in the fuel tank in delivering the DME fuel to the injection pump.

According to the DME fuel supply device for a diesel engine of the ninth aspect of this invention, it is possible to obtain an effect, in addition to the effect of the seventh or eighth aspect, of reducing the possibility that the DME fuel in the fuel tank is evaporated by a decrease in pressure in the fuel tank since it is possible to prevent a significant pressure decrease in the fuel tank in delivering the DME fuel in the fuel tank to the injection pump.

BEST MODES FOR CARRYING OUT THE INVENTION

Description will be made of an embodiment of this invention with reference to the drawings.

First, the general structure of a DME fuel supply device for a diesel engine will be described.

Figure 1:
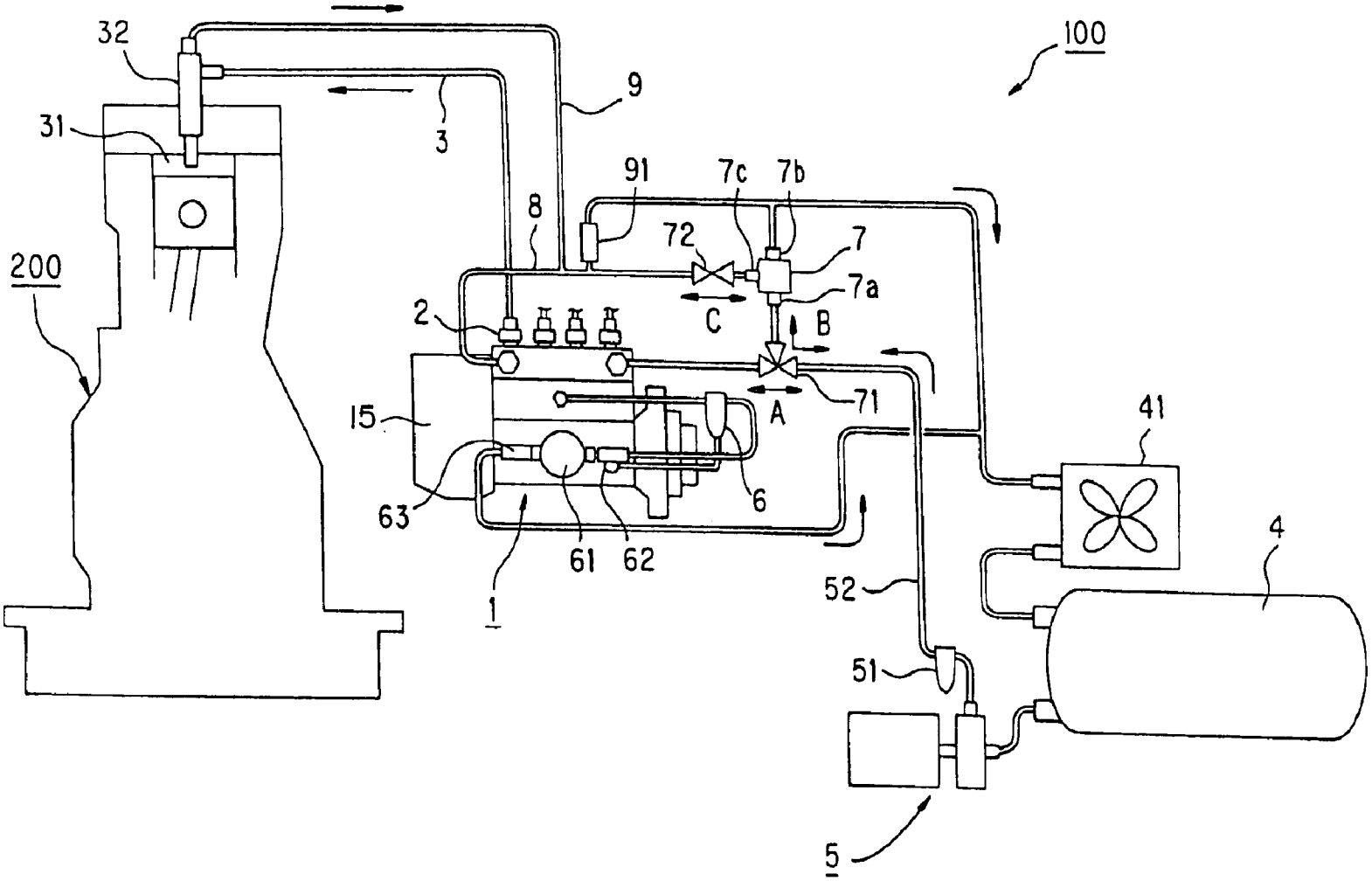
FIG. 1 is a system structural view illustrating the general structure of a DME fuel supply device for a diesel engine according to a preferred embodiment of this invention.

FIG. 1 is a system structural view illustrating the general structure of a DME fuel supply device for a diesel engine according to this invention.

A DME fuel supply device 100 for supplying DME fuel to a diesel engine 200 has an injection pump 1 according to this invention. The injection pump 1 has the same number of injection pump elements 2 as the number of cylinders 31 which the diesel engine 200 has. A feed pump 5 pressurizes DME fuel reserved in the fuel tank 4 to a specified pressure and delivers it into a feed pipe 52. The fuel tank 4 has a DME fuel delivery port which is located below the level of the DME fuel in the fuel tank 4, and the feed pump 5 is disposed in the vicinity of the DME fuel delivery port of the fuel tank 4. The DME fuel delivered into the feed pipe 52 is filtered by the filter 51, and delivered to the injection pump 1 via a three-way solenoid valve 71. The three-way solenoid valve 71 is ON in an injection state (while the diesel engine 200 is operating) and permits flow in the direction indicated by the arrow A.

Since the DME fuel delivery port of the fuel tank 4 is located below the level of the DME fuel in the fuel tank 4, and since the feed pump 5 is disposed in the vicinity of the DME fuel delivery port of the fuel tank 4 and delivers the DME fuel to the injection pump 1, it is possible to prevent a significant pressure decrease in the fuel tank 4. Thus, it is possible to reduce the possibility that the DME fuel in the fuel tank 4 is evaporated by a decrease in pressure in the fuel tank 4.

A cam chamber (not shown) in the injection pump 1 has an exclusive lubricating system which is separated from the lubricating system of the diesel engine 200. An oil separator 6 separates lubricating oil in the cam chamber in the injection pump 1 containing DME fuel leaked into the cam chamber into DME fuel and lubricating oil and returns the lubricating oil to the cam chamber. The DME fuel separated by the oil separator 6 is delivered to a compressor 61 driven by a cam in the cam chamber via a check valve 62 for preventing the pressure in the cam chamber from decreasing to atmospheric pressure or lower, pressurized in the compressor 61, and returned to the fuel tank 4 via a check valve 63 and a cooler 41. The check valve 63 is provided to prevent DME fuel from flowing in reverse direction from the fuel tank 4 to the cam chamber when the diesel engine 200 is stopped.

Since the cam chamber of the injection pump 1 has en exclusive lubricating system separated from the lubricating system of the diesel engine 200, there is no possibility that DME fuel leaked into the cam chamber from the injection pump elements 2 enters the lubricating system of the diesel engine 200. Thus, there is no possibility that DME fuel having entered the lubricating system of the diesel engine 200 is evaporated and the evaporated fuel enters the crank chamber of the engine and is ignited therein.

Since DME fuel mixed in the lubricating oil is separated by the oil separator 6 provided in the cam chamber and the separated DME fuel is delivered to the fuel tank 4 by the compressor 61, it is possible to prevent degradation of the lubrication performance of the lubricating oil caused by DME fuel mixed in the lubricating oil. It is, therefore, possible to prevent the degradation of the performance of the injection pump 1 caused by degradation of the lubrication performance of the lubricating oil or the like.

Further, the compressor 61 is driven by a cam in the cam chamber, there is no need for a driving source, such as an electric motor, for the compressor 61. Thus, it is possible to achieve a low power consumption injection pump 1.

The DME fuel pressurized to a specified pressure by the feed pump 5 and delivered from the fuel tank 4 is delivered under pressure in a specified amount from the injection pump elements 2 of the injection pump 1 to fuel injection nozzles 32 provided in the cylinders 31 of the diesel engine 200 via injection pipes 3 at specified timing. DME fuel overflowed from the injection pump 1 is returned to the fuel tank 4 via an overflow fuel pipe 8, a check valve 91 for determining the pressure of the overflowed fuel and the cooler 41. DME fuel overflowed from the injection nozzles 32 is returned to the fuel tank 4 via an overflow fuel pipe 9, the check valve 91 for determining the pressure of the overflowed fuel, and the cooler 41.

The DME fuel supply device 100 has an aspirator 7, a three-way solenoid valve 71, and a two-way solenoid valve 72 as components of "residual fuel retrieving means" for retrieving DME fuel remaining in an fuel gallery (not shown) in the injection pump 1, the overflow fuel pipe 8, and the overflow fuel pipe 9 to the fuel tank 4 when the diesel engine 200 is stopped.

The aspirator 7 has an inlet 7*a*, an outlet 7*b* and a suction port 7*c*. The inlet 7*a* and the outlet 7*b* are communicated with each other via a straight communication passage, and the suction port 7*c* is branched at generally a right angle from the communication passage between the inlet 7*a* and the outlet 7*b*. The outlet of a communication passage, though which flow (in the communication direction indicated by the arrow B) can pass when the three-way solenoid valve 71 is OFF, is connected to the inlet 7*a*, and the outlet 7*b* is connected to a passage to the fuel tank 4 via the cooler 41. The suction port 7*c* is connected to the two-way solenoid valve 72, which is OFF in the injection state (while the diesel engine 200 is operating).

In the non-injection state (while the diesel engine 200 is not operating), the three-way solenoid valve 71 is turned off to form a communication passage in the direction indicated by the arrow B and the two-way solenoid valve 72 is turned on to communicate the overflow fuel pipe 8 and the overflow fuel pipe 9 to the suction port 7*c* of the aspirator 7 (in the direction indicated by the arrow C). Thus, DME fuel delivered from the feed pump 5 is delivered not to the injection pump 1 but to the aspirator 7, passed from the inlet 7*a* to the outlet 7*b*, returned to the fuel tank 4 via the cooler 41 and delivered again from the feed pump 5 to the aspirator 7. That is, the DME fuel is circulated via the aspirator 7. Then, DME fuel remaining in the fuel gallery in the injection pump 1, the overflow fuel pipe 8 and the overflow fuel pipe 9 is sucked through the suction port 7*c* by the flow of the DME fuel flowing from the inlet 7*a* to the outlet 7*b* and retrieved to the fuel tank 4.

The residual fuel retrieving means uses the feed pump 5 as a driving source and has the aspirator 7 for sucking the DME fuel in the fuel gallery, the overflow fuel pipe 8, and the overflow fuel pipe 9 and retrieving it to the fuel tank 4. Thus, there is no need to provide a pump or the like to retrieve the residual fuel.

Description will be made of the general structure of the injection pump element 2 of the injection pump 1 according to this invention.

Figure 2:
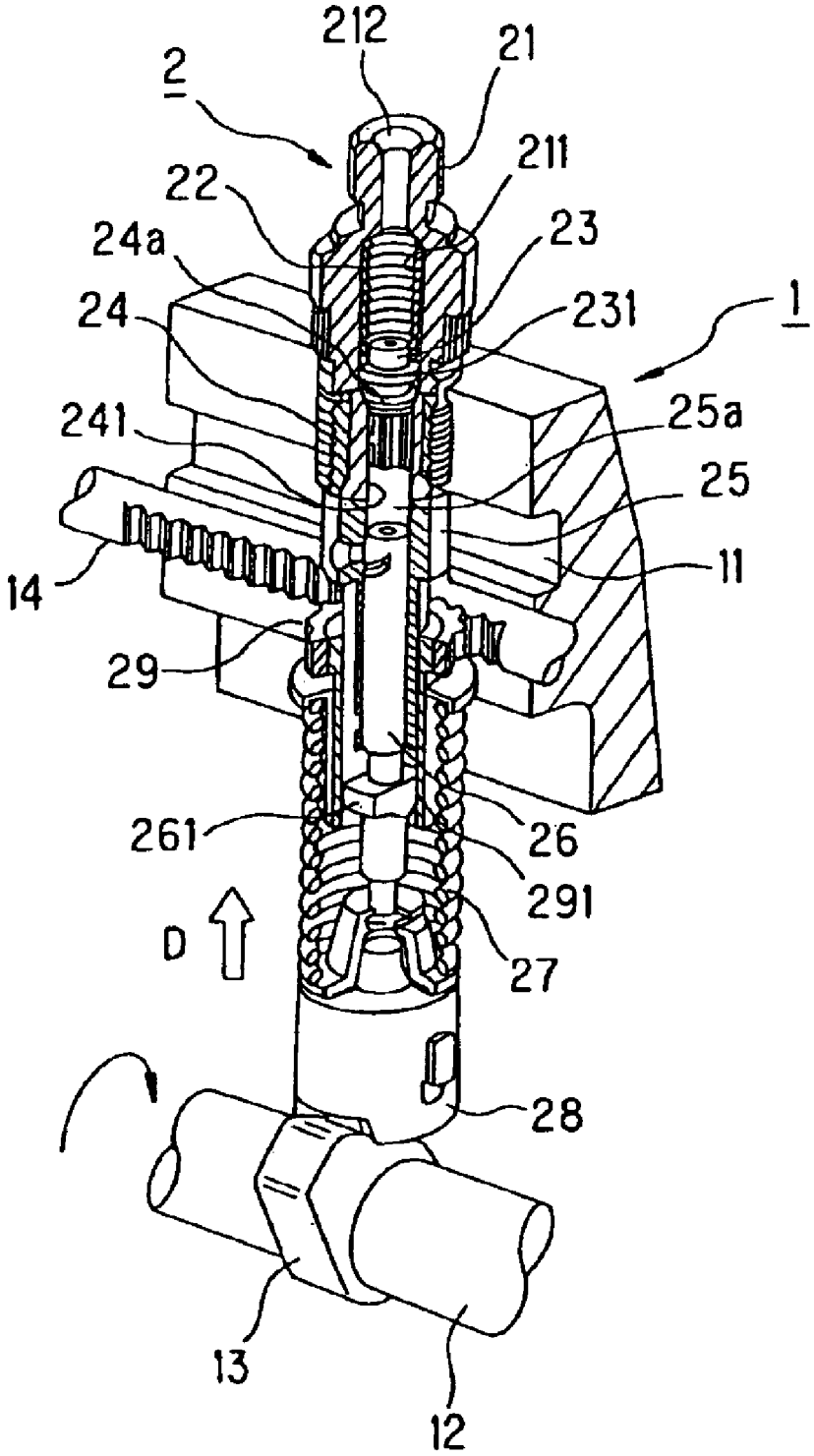
FIG. 2 is a perspective view of an essential part of an injection pump element of the injection pump according to a preferred embodiment of this invention.

FIG. 2 is a perspective view of an essential part of the injection pump element 2 of the injection pump 1 according to this invention.

A delivery valve holder 21 has a delivery valve insertion hole 211 and fixed to the base of the injection pump 1. An injection pipe 3 is connected to a fuel liquid outlet 212 communicated to the delivery valve insertion hole 211. A delivery valve 23 is received in the delivery valve insertion hole 211 for reciprocating movement and is urged by a delivery spring 22 such that a valve part 231 thereof is in contact with a valve seat part 24*a* of a delivery valve seat 24 disposed integrally with the delivery valve holder 21.

A plunger barrel 25 is disposed integrally with the delivery valve seat 24 and has a compression chamber 25*a* communicated to the delivery valve seat 24. A plunger 26 is received in the compression chamber 25*a* for reciprocating movement and has an end opposed to the delivery valve 23. The plunger 26 is urged toward a cam 13 by a plunger spring 27. The plunger 26 is pushed up toward the delivery valve 23 (in the direction indicated by the arrow D) via a tappet 28 by the cam 13 of a camshaft 12 connected to the driving shaft of the diesel engine 200 and rotated by the driving force of the diesel engine 200. The plunger 26 has a flange 261 which is in engagement with a sleeve 291 that is a cylindrical member integrated with a pinion 29 which is in engagement with a control rack 14 and rotated together therewith. The pinion 29 is rotated by the reciprocating motion of the control rack 14, the position of which is controlled by a governor 15 (FIG. 1), and the plunger 26 is thereby rotated circumferentially. The injection amount of DME fuel is increased or decreased according to the rotational position of the plunger 26.

Figure 3:
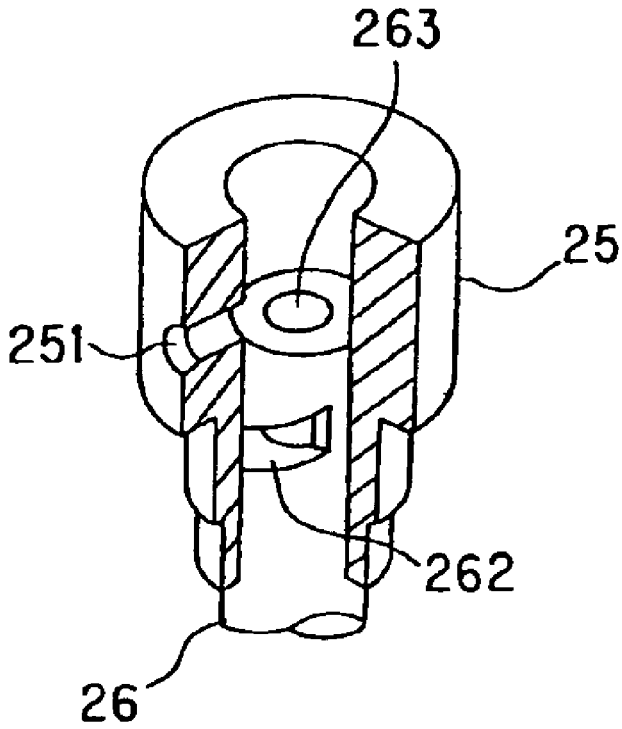
FIG. 3 is an enlarged perspective view of a part of a plunger received in a plunger barrel of the injection pump element.

FIG. 3 is an enlarged perspective view of a part of the plunger 26 received in the plunger barrel 25.

In the injection pump 1, the injection pump element 2 is an important part which can pressurize the DME fuel to a high pressure and increase or decrease the injection amount of the DME fuel. Thus, the sliding portions of the plunger 26 and the delivery valve 23 are finished with super high precision. A suction and discharge port 251 for communicating the fuel gallery 11 and the compression chamber 25*a* is formed through a side wall of the plunger barrel 25. The plunger 26 has a notch 262. The notch 262 is a groove that is cut obliquely in the outer peripheral surface of the plunger 26 as illustrated and communicated to a hole 263 formed through the center of the plunger 26.

Here, the operation of the plunger 26 will be described with reference to FIG. 4 to FIG. 7.

Figure 4:
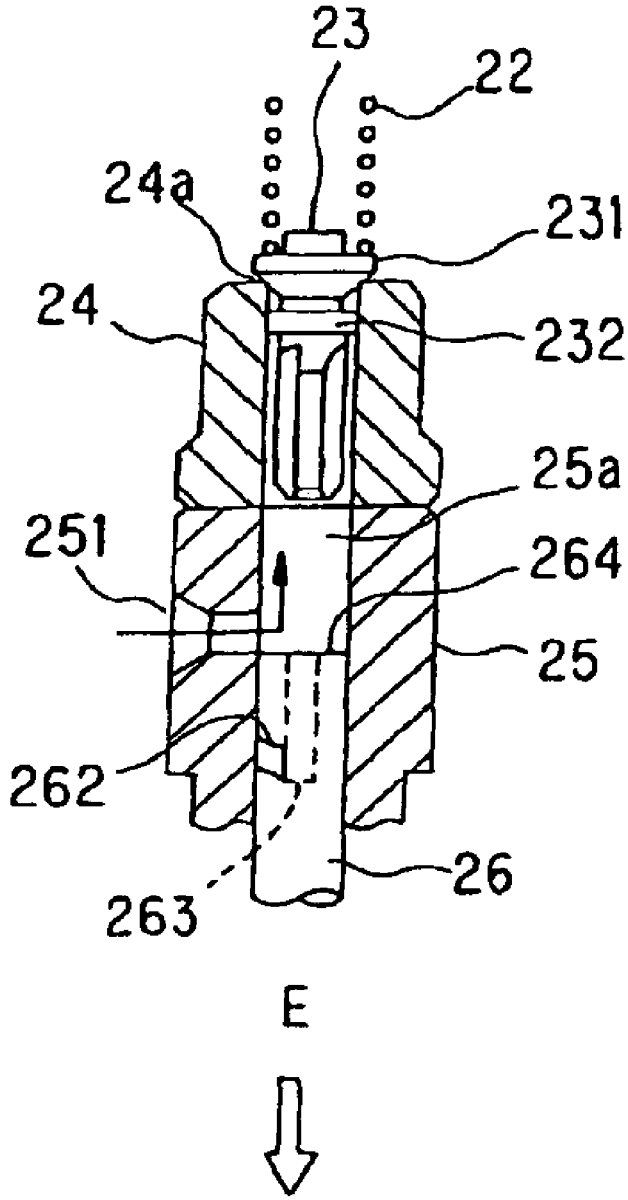
FIG. 4 is a front view illustrating a section of an essential part of the injection pump element during a suction process in an injection state.
Figure 5:
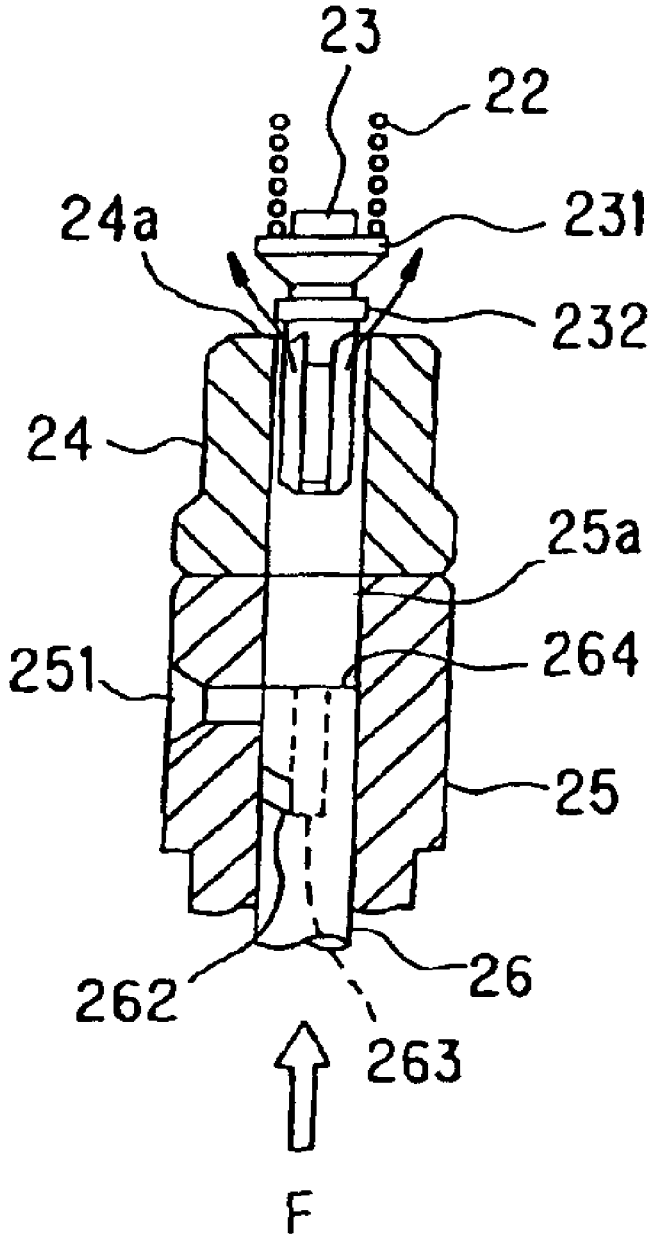
FIG. 5 is a front view illustrating a section of an essential part of the injection pump element at the start of injection during an injection process in the injection state.
Figure 6:
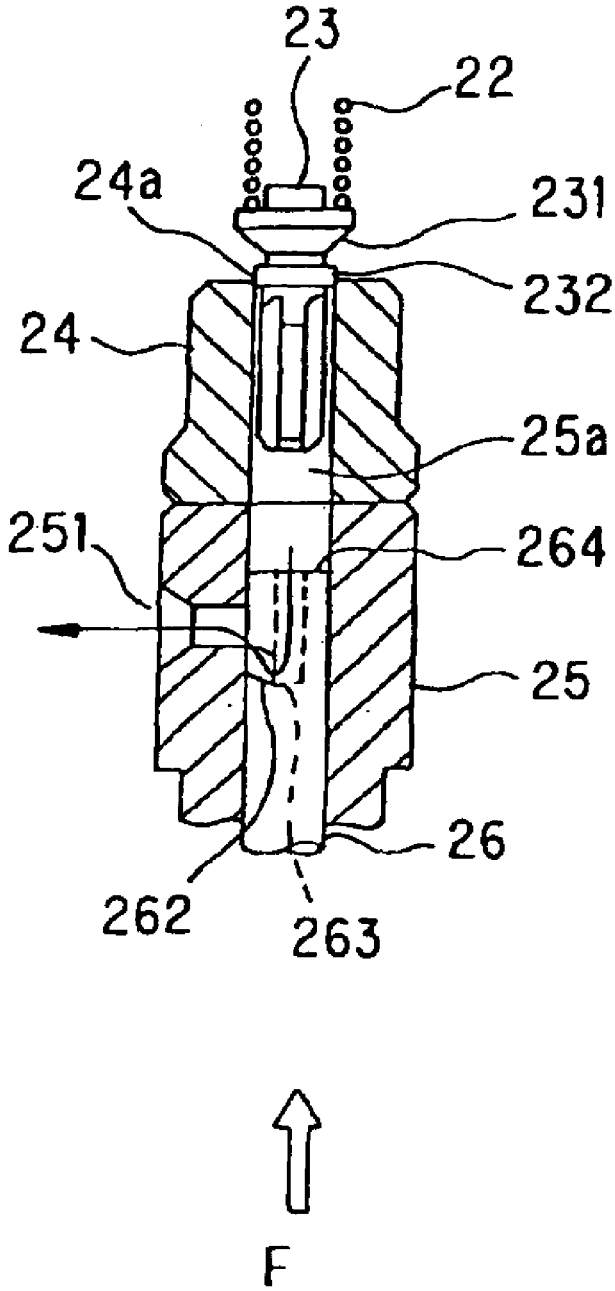
FIG. 6 is a front view illustrating a section of an essential part of the injection pump element at the end of injection during an injection process in the injection state.

FIG. 4 is a front view illustrating a section of an essential part of the injection pump element 2 according to this invention during a suction process in the injection state (while the diesel engine 200 is operating). FIG. 5 shows the injection pump element 2 at the start of injection during the injection process in the injection state, and FIG. 6 shows the injection pump element 2 at the end of injection during the injection process in the injection state.

With downward motion of the cam 13, the plunger 26 is moved down (in the direction indicated by the arrow E). When the upper end 264 of the plunger 26 comes down to the level of the suction and discharge port 251 of the plunger barrel 25, DME fuel in the fuel gallery 11 is delivered into the compression chamber 25*a* through the suction and discharge port 251. The suction of DME fuel is completed when the cam 13 reaches its bottom dead center (suction process). With upward motion of the cam 13, the plunger 26 is moved up. When the upper end 264 of the plunger 26 closes the suction and discharge port 251, the communication between the fuel gallery 11 and the compression chamber 25*a* is shut off (start of injection during the injection process). As the cam 13 is further moved upward, the DME fuel pushes up to open the delivery valve and is delivered under pressure to the injection nozzle of the diesel engine 200 via the injection pipe 3. When the notch 262 of the plunger 26 reaches the suction and discharge port 251, the DME fuel in the compression chamber 25*a* flows by its own pressure into the fuel gallery 11 through the hole 264 of the plunger 26, the notch 262, and the suction and discharge port 251. The pressure of the DME fuel in the compression chamber 25*a* is thereby decreased, and the delivery valve 23 is moved down by the urging force of the delivery spring 22 and closed when the valve part 232 comes into contact with the valve seat part 24*a* of the delivery valve seat 24 (end of injection during the injection process).

The stroke of the plunger 26 from the start of injection (FIG. 5) to the end of injection (FIG. 6) is referred to as effective stroke. DME fuel is delivered under pressure during the effective stroke, and the amount of fuel to be delivered under pressure can be increased or decreased by changing the length of the effective stroke. The notch 262 is formed obliquely with respect to the circumferential direction as illustrated. Thus, by changing the position of the control rack 14 (FIG. 2) to rotate the plunger 26 circumferentially as described before, the distance which the notch 262 of the plunger 26 is to be moved until it reaches the suction and discharge port 251 can be changed. The effective stroke can be thereby changed.

Description will be made of the non-injection state.

Figure 7:
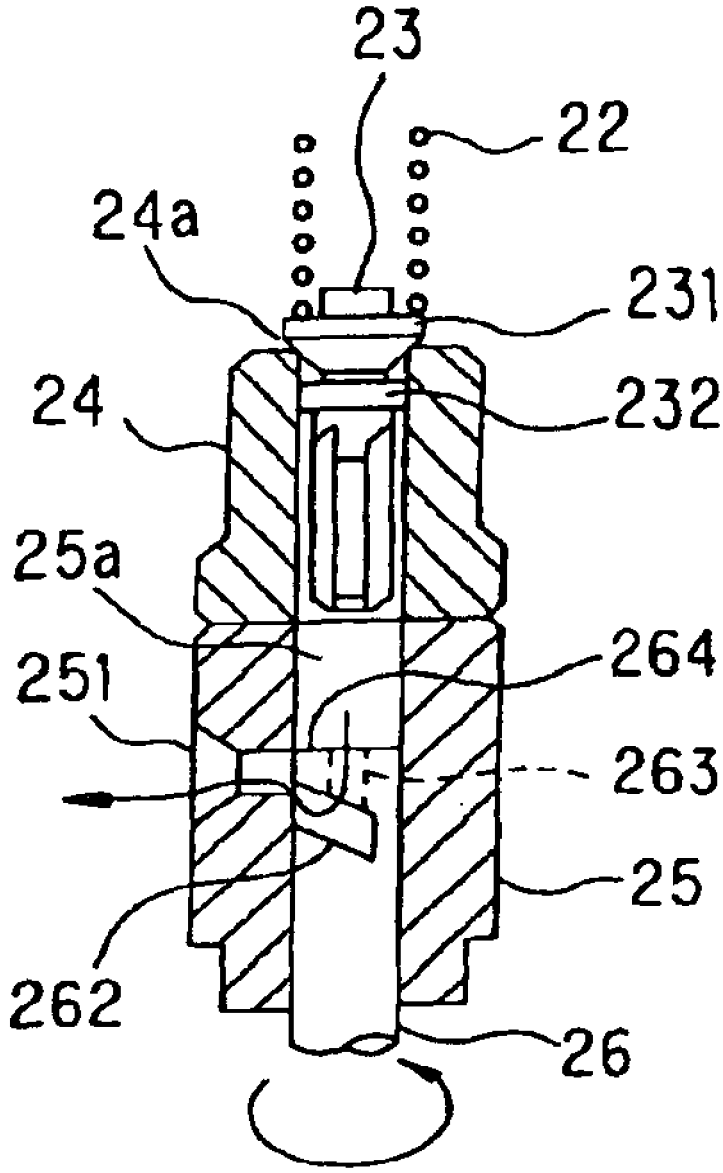
FIG. 7 is a front view illustrating a section of an essential part of the injection pump element in a non-injection state (at the time when the diesel engine is not operating)

FIG. 7 is a front view illustrating a section of an essential part of the injection pump element 2 according to this invention in the non-injection state (while the diesel engine 200 is not operating).

When the control rack 14 is located in such a position that the amount of DME fuel to be delivered under pressure is zero, namely in such a position that the notch 262 reaches the suction and discharge port 251 when the upper end 264 of the plunger 26 closes the suction and discharge port 251, the effective stroke is zero and the compression chamber 25*a* and the chamber 11 are kept communicated with each other even when the plunger 26 is moved upward. Thus, no DME fuel is delivered under pressure even when the plunger 26 is moved up and down by the cam 13. This is the non-injection state. Since DME fuel is not delivered under pressure, the supply of DME fuel to the diesel engine 200 is stopped and the diesel engine 200 is stopped.

Figure 8:
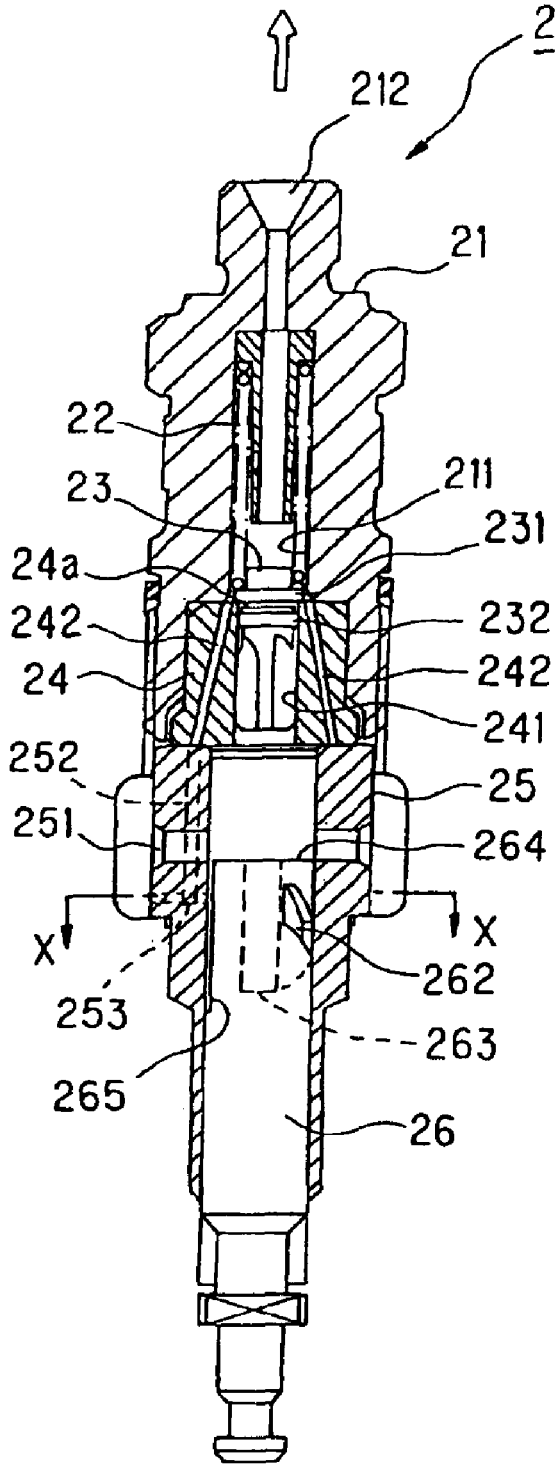
FIG. 8 is a front view illustrating a section of the injection pump element.

FIG. 8 is a front view illustrating a section of the injection pump element 2 according to this invention.

The delivery valve seat 24 is provided with a purge passage 242. One end of the purge passage 242 is communicated to the fuel liquid outlet 212 and the other end of the purge passage 242 is communicated to a purge passage 252 formed in the plunger barrel 25. The purge passage 252 is communicated to a purge port 253 extending to an inner peripheral surface of the plunger barrel 25. That is, the injection pump element 2 has a communication route communicating the injection pipe 3 connected to the fuel liquid outlet 212 and the inner peripheral surface of the plunger barrel 25.

Description will be made of the retrieving route through which DME fuel remaining in the injection pipe 3 is retrieved by the aspirator 7 in the non-injection state.

Figure 9:
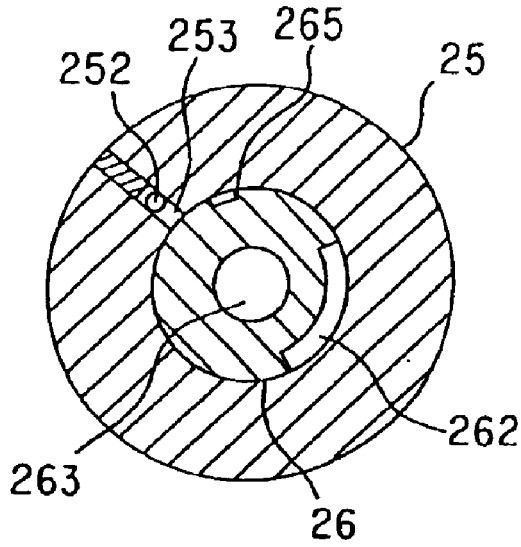
FIG. 9 is a cross-sectional view of the injection pump element taken along the line X—X in FIG. 8, wherein FIG. 9(*a*) shows the injection pump element in the injection state and FIG. 9(*b*) shows the injection pump element in the non-injection state.
Figure 9:
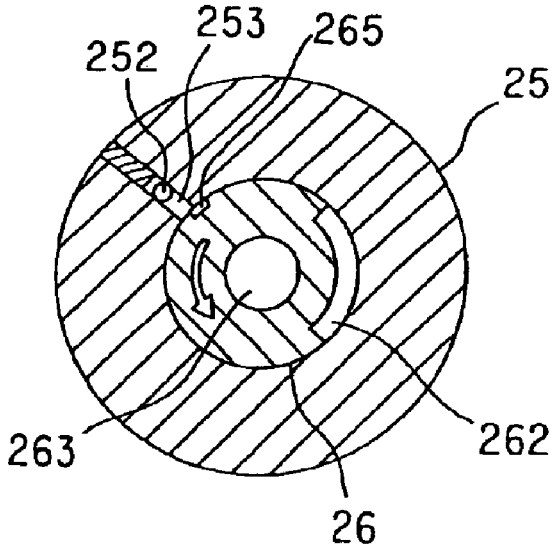

FIG. 9 is a cross-sectional view of the injection pump element 2 according to this invention taken along the line X—X in FIG. 8. FIG. 9(*a*) shows the injection pump element in the injection state and FIG. 9(*b*) shows the injection pump element in the non-injections state.

In the injection state shown in FIG. 9(*a*), namely, when the plunger 26 is in such a rotational position that an effective stroke, by which a specified amount of DME fuel can be delivered under pressure, can be obtained, a purge groove 265 formed axially in the outer peripheral surface of the plunger 26 is not communicated to the purge port 253 formed in the inner peripheral surface of the plunger barrel 25.

In the non-injection state shown in FIG. 9(*b*), the plunger 26 is rotated circumferentially to such a rotational position that the purge groove 265 formed in the outer peripheral surface of the plunger 26 and the purge port 253 formed in the inner peripheral surface of the plunger barrel 25 are communicated to each other. Since the purge groove 265 extends to the upper end 264 of the plunger 26, the purge groove 265 is communicated to the fuel gallery 11 via the hole 263 and the notch 262. That is, in the non-injection state, a purge passageway is formed by the purge passage 242, the purge passage 252, the purge port 253, the purge groove 265, the hole 263, and the notch 262, and the injection pipe 3 is thereby communicated to the fuel gallery 11 even if the delivery valve 23 is closed. Thus, by retrieving DME fuel in the fuel gallery 11 with the aspirator 7 in the non-injection state, DME fuel in the injection pipe 3 communicated to the fuel gallery 11 can be retrieved through the purge passageway.

Figure 10:
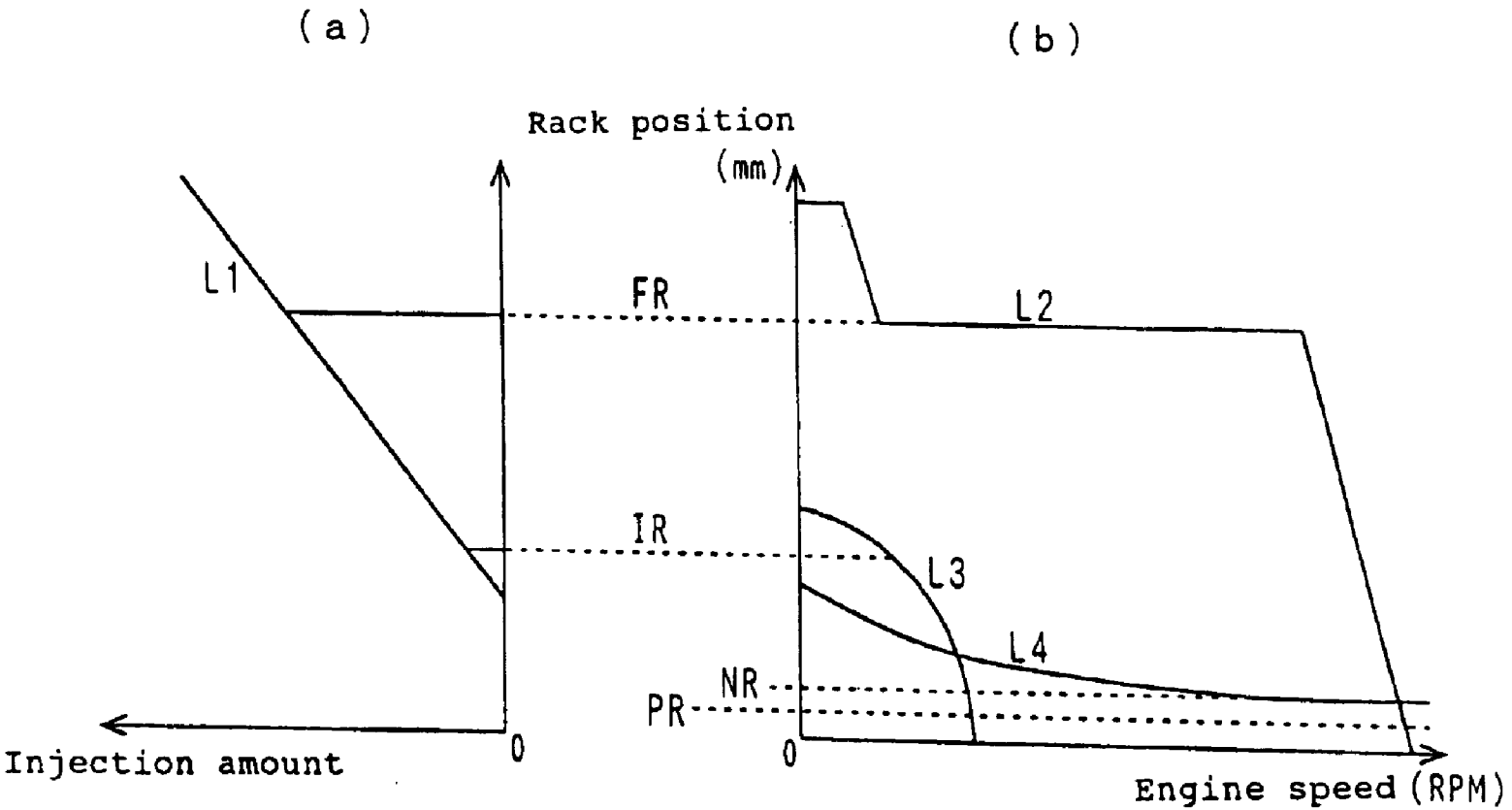
FIG. 10 is a graph showing governor curves according to which a governor adjusts the rack position and a plunger effective stroke curve in the injection pump according to a preferred embodiment of this invention, wherein FIG. 10(*a*) is the plunger effective stroke curve and FIG. 10(*b*) is the governor curves.

FIG. 10 is a graph showing governor curves according to which the governor 15 adjusts the rack position and a plunger effective stroke curve in the injection pump 1 according to a preferred embodiment of this invention. FIG. 10(*a*) shows the plunger effective stroke curve and FIG. 10(*b*) shows the governor curves.

The plunger effective stroke curve shown in FIG. 10(*a*) shows the relation between the rack position of the control rack 14 (FIG. 2), the position of which is controlled by the governor 15 (FIG. 1), and the amount of fuel injected from the fuel injection pump element 2 which is increased or decreased according to the rotational position of the plunger 26, which is in engagement with the control rack 14 and rotated thereby (L1). In the drawing, FR, IR, NR and PR indicate the full rack position, the idle rack position, the non-injection rack position and the purge rack position of the control rack 14, respectively.

The governor curves shown in FIG. 10(*b*) are control curves for the governor 15 showing the relation between the rack position of the control rack 14 and the rotational speed of the diesel engine 200. The governor 15 controls the rack position of the control rack 14 according to the control curve designated as L2 during high-speed operation and controls the rack position of the control rack 14 according to the control curve designated as L3 during low-speed operation or idling. The region designated as L4 is a non-control region in which the injection pump element is in the non-injection state.

The purge rack position PR is provided below the non-injection rack position NR (on the side of the non-injection region). When the remaining DME fuel is retrieved by the residual fuel retrieving means after the control rack 14 has been moved to the non-injection rack position NR to bring the injection pump element 2 into the non-injection state and the diesel engine 200 has been stopped, the governor 15 moves the control rack 14 further to the non-injection side until it reaches to the purge rack position PR. When the control rack 14 reaches the purge rack position PR, the plunger 26 is in such a rotational position that the purge groove 265 formed in the outer peripheral surface of the plunger 26 and the purge port 253 formed in the inner peripheral surface of the plunge barrel 25 are communicated to each other.

Thus, when the DME fuel remaining in fuel gallery 11 and the like is to be left unretrieved in the non-injection state after stopping the diesel engine 200, namely when the engine is stopped by an idle stop function or the like, the control rack 14 is positioned in the non-injection rack position NR so that the purge passageway cannot be formed even if the injection pump element is in the non-injection state. Also, since the purge rack position PR is provided, the adjustment of the rotational position of the plunger 26 at which the purge passageway is formed and the rack position of the control rack 14 can be adjusted easily and reliably in the work of adjusting the injection pump element 2 and the governor 15. Further, since the purge rack position PR is provided on the non-injection state side from the non-injection rack position NR within the moving range of the control rack 14, there is no possibility that the purge passageway is formed when the injection pump element 2 is in the injection state.

As has been described previously, in the DME fuel supply device 100 for a diesel engine according to this invention, the injection pipe 3 and the fuel gallery 11 are communicated to each other in the non-injection state after stopping of the diesel engine 200 even if the delivery valve 23 is closed (as long as the control rack 14 is in the purge rack position PR). Thus, the DME fuel remaining in the injection pipe 3 can be retrieved when the DME fuel in the fuel gallery 11 is retrieved with the aspirator 7. It is, therefore, possible to avoid abnormal combustion such as knocking which prevents the diesel engine 200 from starting normally and causes significant vibration and noise.

It should be understood that this invention is not limited to the above embodiment and that various changes and modifications may be made within the scope of the invention described in the scope of the appended claims and those are also included in the scope of this invention.

Industrial Applicability

An injection pump according to this invention is suitably used as an injection pump of a DME fuel supply device for a diesel engine. Also, the DME fuel supply device according to this invention can be suitably use as a DME fuel supply device for a diesel engine.

What is claimed is:

1. An injection pump of a dimethyl ether (DME) fuel supply device for a diesel engine having a feed pump for pressurizing DME fuel in a fuel tank to a specified pressure and delivering it into a feed pipe, an injection pump having an injection pump element with a delivery valve which can be opened and closed by up and down movement of a plunger in engagement with a camshaft rotated by rotation transmitted from a driving shaft of said diesel engine and which can deliver DME fuel in a fuel gallery delivered via said feed pipe in a specified amount to an injection pipe communicated to a fuel injection nozzle of said diesel engine at specified timing, an overflow fuel pipe for returning DME fuel overflowed from said fuel injection nozzle and DME fuel overflowed from said injection pump to said fuel tank, and residual fuel retrieving means for retrieving DME fuel remaining in said fuel gallery and said overflow fuel pipe after stopping said diesel engine to said fuel tank, said injection pump comprising injection state switching means for switching said injection pump element between an injection state in which said delivery valve is opened and closed by a cam of said camshaft and a non-injection state in which said delivery valve is not opened and closed even when said plunger is moved up and down by said cam, wherein said injection pump element allows communication between said injection pipe and said fuel gallery even if said delivery valve is closed only in said non-injection state.

2. The injection pump of claim 1, wherein said plunger of said injection pump element has a generally cylindrical shape and is rotated circumferentially in a plunger barrel by said injection state switching means and the injection amount of said DME fuel is changed according to the rotational position of said plunger, and wherein said injection pump element is brought into said non-injection state and a purge passageway for communicating said injection pipe and said fuel gallery is formed when said plunger is rotated to such a rotational position that said injection amount is zero.

3. The injection pump of claim 2, wherein said injection pump element has a delivery valve holder having a delivery valve insertion hole communicated to said injection pipe, said delivery valve received in said delivery valve insertion hole for reciprocating movement, a delivery valve seat disposed integrally with said delivery valve holder and having a valve seat part for shutting off the communication between said injection pipe and said fuel gallery to establish a valve-closed state when a valve part of said delivery valve comes into contact with it, a delivery spring for urging said delivery valve toward said delivery valve seat, a plunger barrel disposed integrally with said delivery valve seat and having a compression chamber communicated to said delivery valve seat, said plunger received in said compression chamber for reciprocating movement and having an end opposed to said delivery valve, and a plunger spring for urging said plunger toward said cam, wherein, when said injection pump element is in said injection state, said plunger is pushed up from said valve-closed state by said cam to shut off the communication between said compression chamber and said fuel gallery, DME fuel in said compression chamber pushes up to open said delivery valve and brings said delivery valve into an open state, said DME fuel in said compression chamber is delivered under pressure to said injection pipe through said delivery valve in said open state, said compression chamber and said fuel gallery are communicated to each other again via a notch formed in an outer peripheral surface of said plunger, and the pressure in said compression chamber is decreased and said delivery valve is closed by the urging force of said delivery spring, and wherein, when said injection pump element is in said non-injection state, said plunger is rotated circumferentially to such a rotational position that a purge groove formed in an outer peripheral surface of said plunger and a purge port formed in an inner peripheral surface of said plunger barrel are communicated to each other by said injection state switching means, and said injection pipe and said fuel gallery are communicated to each other via said purge port, said purge groove, and a purge passage formed in said delivery valve seat for communicating said injection pipe and said purge port.

4. The injection pump of any one of claims 1 to 3, wherein said injection pump has a cam chamber in which said camshaft is placed and lubricating oil is contained and which has an exclusive lubricating system separated from a lubricating system of said diesel engine, and wherein an oil separator for separating DME fuel from lubricating oil containing DME fuel and a compressor driven by a cam of said camshaft for pressurizing said separated DME fuel and delivering it to said fuel tank are disposed in said cam chamber.

5. The injection pump of any one of claim 2, wherein said injection state switching means has a control rack engaged with said plunger and disposed to make a reciprocating movement for rotating said plunger circumferentially, and a governor having high-speed control means for drawing said control rack in a direction to decrease the fuel injection amount so that the rotational speed of said diesel engine cannot exceed a permissible maximum limit, wherein said control rack has a purge rack position outside its moving range between a full rack position determined by said high-speed control means and a non-injection rack position at which said injection pump element is switched from said injection state to said non-injection state, wherein said governor moves said control rack to said purge rack position when said residual fuel retrieving means retrieves said DME fuel remaining in said fuel gallery and said overflow fuel pipe to said fuel tank after the stopping of said diesel engine, and wherein said injection pump element is in said non-injection state with said purge passageway formed only when said control rack is in said purge rack position.

6. The injection pump of claim 5, wherein said purge rack position is provided on the non-injection state side from said non-injection rack position within the moving range of said control rack.

7. A DME fuel supply device for a diesel engine provided with an injection pump according to any one of claim 1.

8. The DME fuel supply device for a diesel engine of claim 7, wherein said residual fuel retrieving means has an aspirator which is interposed between said feed pipe and said overflow fuel pipe and which circulates DME fuel delivered from said feed pump to said fuel tank so that said DME fuel remaining in said fuel gallery and said overflow fuel pipe can be sucked by the circulating DME fuel and retrieved to said fuel tank.

9. The DME fuel supply device for a diesel engine of claim 7, wherein said feed pump is disposed in the vicinity of a DME fuel delivery port of said fuel tank which is located below the liquid level of DME fuel in said fuel tank.

* * * * *